United States Patent [19]

Blessing

[11] 4,203,590

[45] May 20, 1980

[54] GRIPPER BELT TRANSFER

[75] Inventor: Hubert Blessing, Dallas, Tex.

[73] Assignee: Levi Strauss & Co., San Francisco, Calif.

[21] Appl. No.: 867,811

[22] Filed: Jan. 9, 1978

[51] Int. Cl.[2] ..... B65H 7/02; B65H 29/04

[52] U.S. Cl. ..... 271/265; 271/204; 271/277

[58] Field of Search ..... 271/265, 277, 204, 205, 271/206; 250/571

[56] References Cited

U.S. PATENT DOCUMENTS

| | | | |
|---|---|---|---|
| 2,025,371 | 12/1935 | Beidler | 271/199 |
| 3,126,848 | 3/1964 | Gastongway | 226/11 |
| 3,241,831 | 3/1966 | Axlid | 271/265 X |
| 3,243,182 | 3/1966 | Dexter | 271/199 X |
| 3,266,796 | 8/1966 | Haney | 271/265 |
| 3,633,903 | 1/1972 | Foster | 271/199 X |
| 3,759,177 | 9/1973 | Gazzola | 271/64 X |
| 3,966,196 | 6/1976 | Simeth | 271/218 |
| 4,026,199 | 5/1977 | Adams | 93/36 A |

*Primary Examiner*—Richard A. Schacher
*Attorney, Agent, or Firm*—Limbach, Limbach & Sutton

[57] ABSTRACT

A fabric workpiece removal mechanism which includes a pair of spaced apart pulley wheels, a continuous drive belt of resilient material entrained about the wheels, a switch actuated motor for intermittently driving the wheels and the belt, at least one gripper finger clamped to the belt for clasping the edge of a fabric workpiece against the belt, the gripper finger being bent inwardly toward the belt to deform the belt from its natural configuration and a sensor switch for detecting the presence of the fabric workpiece edge between the gripper finger and the belt and for then energizing the belt drive motor.

7 Claims, 5 Drawing Figures

GRIPPER BELT TRANSFER

BACKGROUND OF THE INVENTION

This invention relates to a sheet transfer device and more specifically to a gripper belt transfer device.

In handling of sheet materials, particularly in the book printing and photographic industry a common method of transferring sheets is by means of a conveyor chain upon which one or more grippers are mounted. The grippers fasten on the edge of the sheet of material and transport it as the chain moves along between one or more pulley or gear wheels. Representative examples of such devices are disclosed in U.S. Pat. Nos. 2,025,371 (Beidler); 3,966,196 (Simeth) and 3,633,903 (Foster).

The gripper chains may be actuated by contact with the edge of the sheet to be transferred (Beidler) or may be actuated by some other means. Photo-optic sensors may be used to control the operation of the machine, as shown in the Foster patent. In all of these devices, however, the sheet which is being transferred is required to have a certain degree of stiffness in order to trip the chain drive actuator. The chains are metallic and therefore require oiling, rendering them unsuitable for use in the fabric industry where such oil would spoil the fabric. Also, because of the greater mass of such metallic transfer devices, their response time is far too slow to meet all transfer needs within the garment manufacturing industry which require a high speed response. There is further the problem that chain-transfer devices which must necessarily be exposed to some degree, are unsafe for mechanically unsophisticated sewing machine operators.

SUMMARY OF THE INVENTION

The above and other disadvantages of prior art gripper transfer devices are overcome by the present invention of the fabric workpiece removal mechanism comprising a pair of spaced-apart wheels, a continuous drive belt of resilient material entrained about the wheels, a switch actuated drive motor for intermittently driving the wheels, and thus the belt, and at least one gripper finger clamped to the belt. A portion of the gripper finger is bent inwardly toward the belt to deform the belt from its natural configuration so that after the fabric workpiece is inserted between the gripper finger and the belt, the edge of the fabric workpiece is firmly clasped. A sensor switch detects the presence of the fabric workpiece edge between the gripper finger and the belt and then energizes the drive motor.

The fabric workpiece can be inserted between the gripper finger and the belt when the gripper finger is caused to arc away from the belt. This action takes place as the gripper finger and the belt portion to which it is attached pass around the pulley wheels. Alternatively, it can be accomplished by means of a cam which engages the gripper finger. Similarly, the workpiece can be released in the same two ways.

In the preferred embodiment, the gripper finger includes a reflecting surface which is covered by the fabric workpiece when the fabric workpiece is positioned between the gripper finger and the belt. A light source directs light upon the reflecting surface. The sensor switch includes a statically positioned photo-optic sensor switch for sensing the presence of the gripper finger at a particular location along its path of travel on the moving belt by detecting light which is reflected from the uncovered reflecting surface. The photo-optic sensor switch is electrically opened when it detects the reflected light and is electrically closed at all other times.

This photo-optic sensor switch is connected to the drive motor so that when the fabric workpiece is inserted between the gripper finger and the belt at the predetermined position, thereby covering the reflecting surface of the gripper finger, the photo-optic sensor switch energizes the drive motor to carry the gripped workpiece along the path of travel of the belt until the gripper finger is caused to arc away from the belt and release the workpiece as described previously. In this way, a completely limp fabric workpiece is able to actuate the belt drive motor. It should also be noted that even after the workpiece is released, the motor continues to drive the belt until the gripper finger has returned to its initial position and causes light to be reflected to the photo-optic sensor switch. At this point, the photo-optic sensor switch deenergizes the motor, completing one cycle of operation.

In the preferred embodiment, a horizontal workpiece stacking surface is provided somewhere along the path of travel of the belt. This horizontal surface is preferably rotated about a vertical axis and receives the workpieces which are carried by the belt and released over the rotating surface. In this way, the workpieces are shingle-stacked. Such a rotary table stacking device, although known for use with other types of conveyor belts, has not heretofore been used with the gripper belt of the present invention.

While the invention has been described as utilizing only a single gripper, it should be apparent that in other embodiments, a plurality of gripper fingers can be clamped along the belt at spaced apart locations. In still other embodiments, dual, side-by-side gripper belts according to the invention can be operated in tandem to grip and transport a single workpiece. Also, speed changes can be accommodated by receiving and gripping a moving workpiece at one speed and transporting and releasing it at a different speed. The gripper belt of the invention can be operated horizontally, vertically or sloped.

The gripper belt transfer apparatus of the present invention has the further advantage of extreme low mass since the belt is made our of a continuous piece of lightweight material such as a synthetic or natural semi-elastomer or a composition fiber material similar to that commonly used for automatic fan belts. It also does not require any oiling which might soil the workpieces. The light weight and low mass characteristic allows the apparatus to have a high response time and little, if any, impact on stopping. The device of the invention also is extremely well suited for limp fabric workpieces and for the self-actuation of the gripper device by such limp fabric workpieces. Furthermore, since the apparatus and its actuation control are extremely simple, the maintenance requirements of the apparatus are minimal.

It is, therefore, an object of the present invention to provide a self-actuated gripper transfer mechanism for limp fabric workpieces.

It is another object of the present invention to provide a gripper transfer mechanism for use in the garment industry which has a low mass for fast response both in acceleration and deceleration.

It is still another object of the present invention to provide a gripper transfer mechanism which is easily maintainable and safe to operate.

The foregoing and other objectives, features and advantages of the invention will be more readily understood upon consideration of the following detailed description of certain preferred embodiments of the invention, taken in conjunction with the accompanying drawings.

DETAILED DESCRIPTION OF CERTAIN PREFERRED EMBODIMENTS

Figures 1, 2A, 2B, 2C:
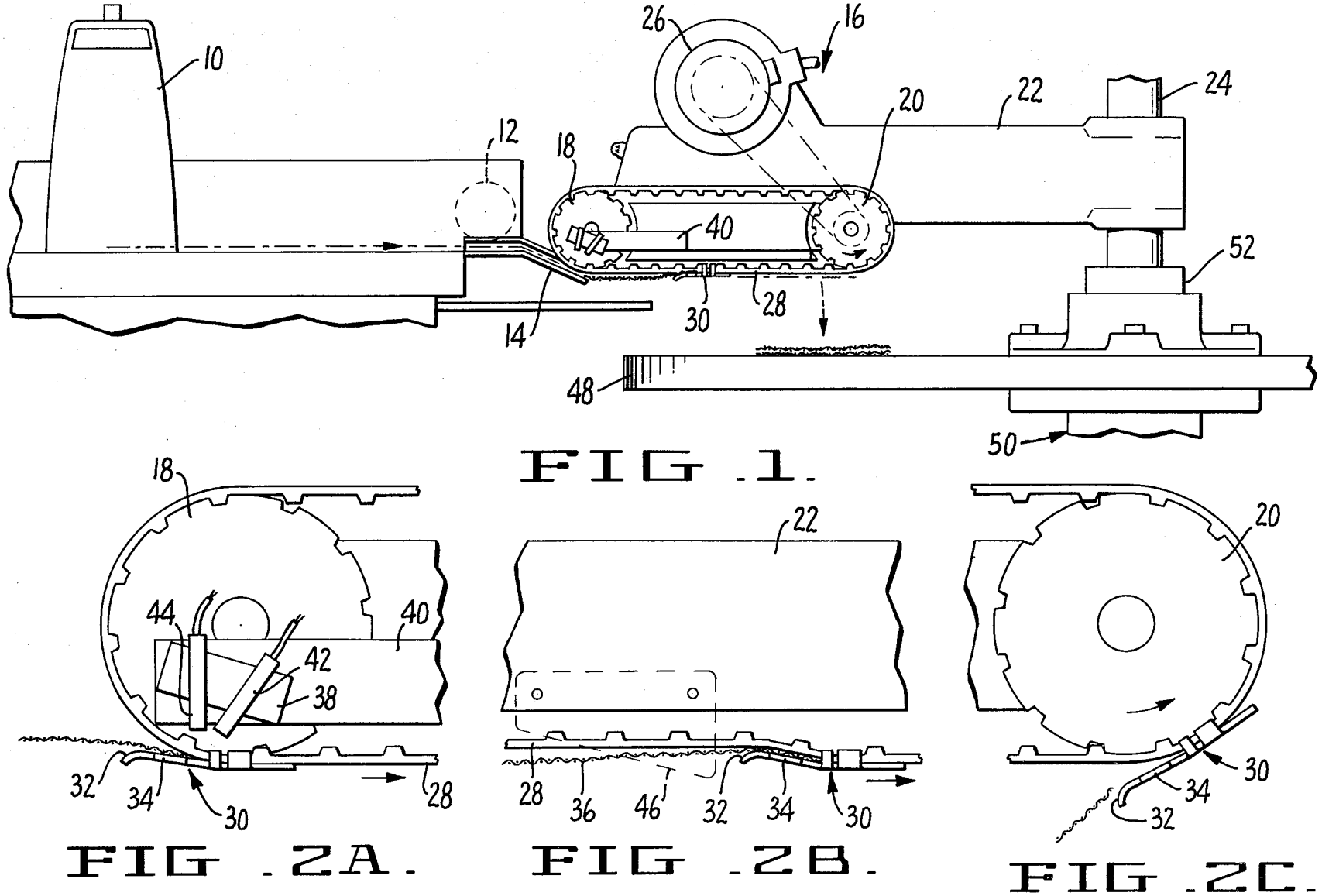
FIGS. 1 is a side view in elevation of the gripper belt transfer device according to the invention together with associated sewing machinery and the stacking table.
FIG. 2A, 2B and 2C are enlarged, side views of the invention with portions broken away.

Referring now more particularly to FIG. 1, one arrangement of the preferred embodiment is illustrated. In this arrangement, a workpiece at a sewing machine station 10 is sewn by the sewing machine and is then transported by means of a conveyor belt 12, or the like, away from the sewing machine 10 to a point where it slides off the conveyor belt and down an inclined guide ramp 14 to be received and transported by the gripper belt device 16, according to the invention. The conveyor belt is preferably of the type which holds the workpiece between an upper and a lower moving belt so that the relative angular position of the workpiece is kept constant. Since the sewing machine 10, the conveyor belt 12 and the ramp 14 are all conventional devices, they will not be described in further detail. The fabric workpieces which are sewn and transported to the input of the gripper belt are, typically, back pocket facings for use in the fabrication of a garment. Thus, the fabric workpieces are substantially limp.

The gripper belt transfer device is comprised of a pair of left and right pulley wheels 18 and 20 are viewed in FIG. 1, respectively, which are rotatably mounted on a horizontal frame 22. The frame 22 is supported at one end on an upright stanchion 24 which rests on the floor. The pulley wheel 20 is driven by a switch actuated motor 26 which is also mounted on the horizontal support 22. The motor 26 can be a synchronous type stepping motor, for example. A resilient, continuous, low mass belt 28 is entrained about the pulley wheels 18 and 20. As mentioned above, the belt can be a natural or a synthetic semi-elastomer or a composition fabric material, for example. One or more grippers 30 are crimped onto the belt 28 so as to travel with the belt as it rotates about the revolving pulley wheels 18 and 20. The belt 28 is provided with teeth which mesh in corresponding teeth in the pulley wheels 18 and 20 to prevent slipping of the belt on the pulley wheels.

Figure 4:
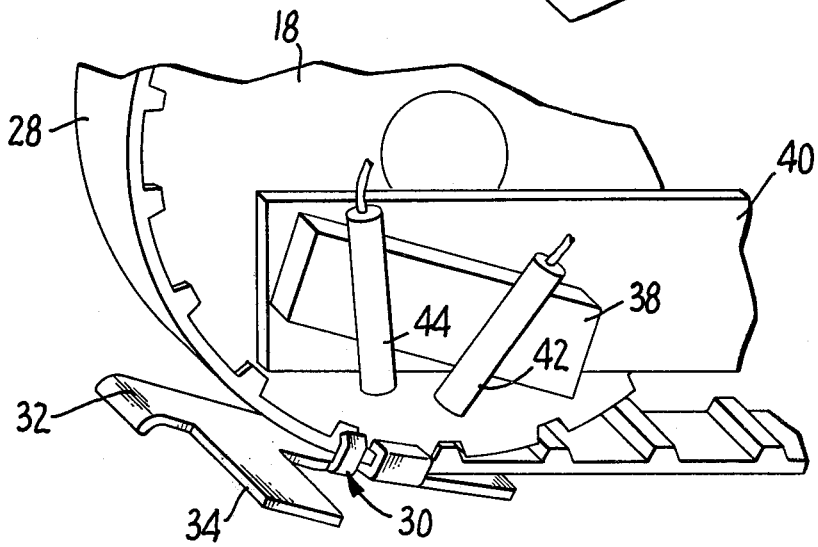
FIG. 4 is an enlarged, perspective view of a portion of the gripper belt transfer mechanism depicted in FIG. 2A.

As best viewed in FIGS. 2A, 2B and 4, the gripper 30 is a unitary member which is provided with a bent finger portion 32 which normally presses inwardly against the belt 28 to deform it from its natural configuration. When the gripper 30 passes about the curvature of one of the pulley wheels 18 or 20, this bent finger portion 32 arcs away from the belt so that space is provided between the bent portion 32 and the belt. When this space is created, the fabric workpiece 36 can be either inserted or released from engagement between the gripper 30 and the belt 28.

The workpiece 36 on the leftmost portion of FIG. 2 is inserted from the inclined guide 14 (shown in FIG. 1) into the space created between the gripper 30 and the belt 28 as it passes around the curvature of the wheel 18. Upon insertion, the workpiece 36 covers up a projecting reflecting surface 34 mounted on the side of the gripper finger 32. A photo-optic sensor switch assembly 38 is mounted on the arm 40 which is attached to the horizontal frame 22. The sensor switch assembly 38 senses that the surface 34 has been covered by the workpiece 36. The arm 40 and the photo-optic sensor switch assembly 38 are mounted above both the workpiece 36 and the reflecting surface 34 and nearly adjacent to the axis of rotation of the wheel 18 (see FIG. 4).

The photo-optic sensor switch assembly 38 includes a light source 42 for projecting a beam of light toward the reflecting surface 34 and a photo-cell 44 for detecting the light reflected from the surface 34. The switch assembly 38 is pivotably mounted on the arm 40 so that the point at which the gripper 30 is detected beneath the sensor switch assembly 38 may be varied to some extent as it passes around the curvature of the wheel 18 by pivoting the sensor switch assembly 38. The sensor switch assembly 38 controls the operation of the motor 26 as will be explained in greater detail in reference to FIG. 5.

Although the fabric workpiece 36 is released as the gripper 30 passes about the pulley wheel 20, the workpiece 36 may also be released by means of a cam surface 46 mounted on the horizontal support arm 22 at a position intermediate the wheel 18 and 20. The cam surface 46 deflects the bent finger portion 32 away from the belt by engaging the reflecting surface 34. The cam surface 46 is shown in dash-line fashion in FIG. 2B since it is an alternative embodiment to the primary embodiment shown in FIG. 1. A workpiece could also be inserted by the same procedure. It should also be apparent that the cam surface, in other embodiments, need not be stationary.

Figure 3:
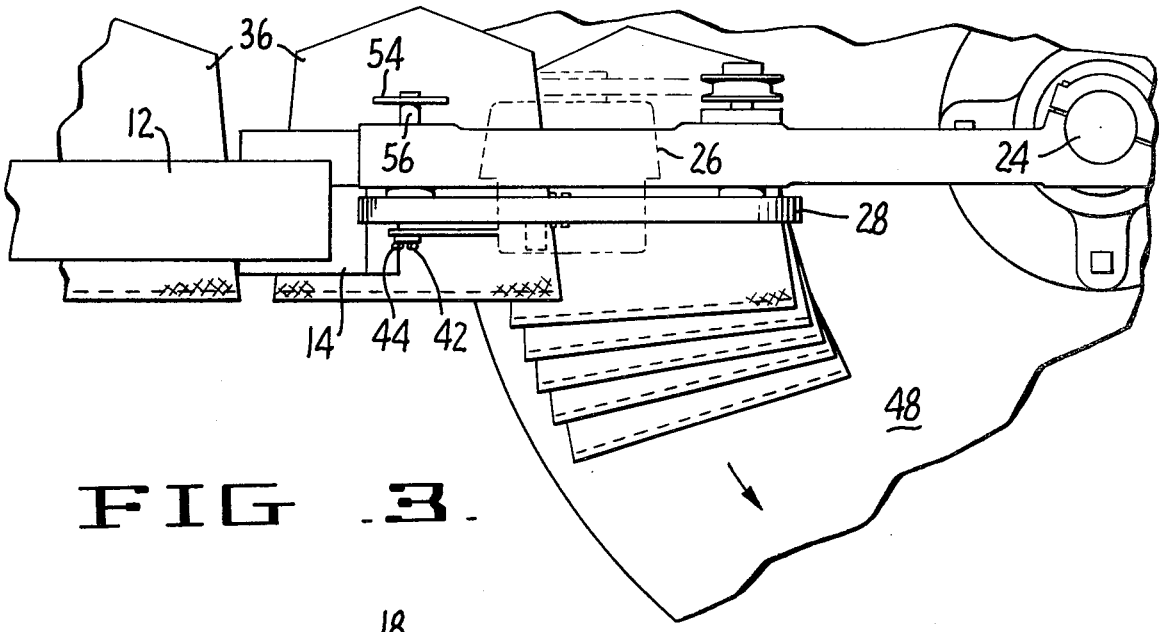
FIG. 3 is a top view of the gripper belt transfer mechanism depicted in FIG. 1, drawn at a slightly smaller scale.

As best shown in FIGS. 1, and 3, the released workpieces 36 drop onto a circular, horizontal surface or table 48 which revolves about the stanchion 24. The table 48 is revolved by means of a motor and wheel combination 50 which is mounted on the stanchion beneath the table 48. The table 48 is revolved at a speed which is variable and which is selected so that the workpieces 36 which are released are shingle stacked as best shown in FIG. 3. This prevents the workpieces from tipping over or becoming misaligned. The height of the table 48 is adjustable along the stanchion 24 by means of any of a variety of well-known mechanisms such as set screws, for example. The table 48 revolves on a bearing race 52 which is coaxial with the stanchion 24.

Figure 5:
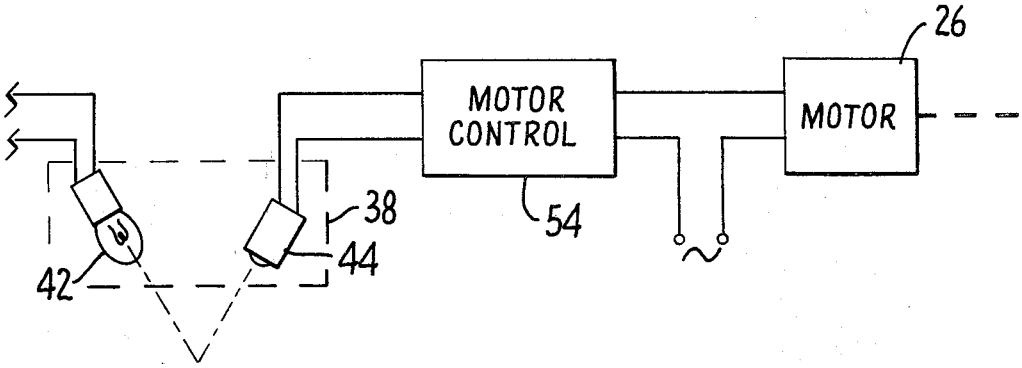
FIG. 5 is a schematic diagram of the electrical control system for the gripper belt transfer mechanism of the invention.

Referring now more particularly to FIG. 5, the photo-optic sensor switch assembly 38 is connected to a motor control 54 which supplies power to the motor 26. Since the motor control 54 is comprised of conventional electronic or electro-mechanical switches, it will not be described in further detail. The photo-optic sensor switch assembly 38 in combination with the motor control 54 is the equivalent of a normally electrically closed switch which becomes electrically open when light is reflected from the gripper surface 34. Thus, the motor 26 is energized by the photo-optic sensor switch assembly 38 when the reflecting surface 34 is first covered by the fabric workpiece 36 when it is inserted between the gripper finger 32 and the belt 28. The motor 26 thereafter remains energized, because the gripper has moved out of position to reflect light to the photo-cell 44, until the gripper 30 returns to the initial or loading position and light is again reflected to the photo-cell 44 by the gripper surface 34.

Because of the low mass of the moving parts of the present gripper belt assembly, it has an extremely fast response for mechanical devices of its type. This makes it ideally suitable for use in the automated garment industry where self-actuated, fast response devices are necessary to interlink one automated device with another.

While only a single belt assembly is shown and described, it should be apparent that dual, side-by-side belts could similarly be operated in tandem to grip and transport a single workpiece. Such belts could be operated on pulley wheels which are mounted on separate axles connected to the wheels 18 and 20, for example.

In all embodiments, in order to engage the workpiece with the belt gripper it is necessry that there be a net forward movement of workpiece relative the the gripper. In the above described preferred embodiment, the gripper is initially held stationary while the workpiece slides into place. In other embodiments, the motor control 54 includes a reversing relay and a time delay switch which are connected together to cause the drive motor 26 to momentarily reverse direction upon detection of light from the reflecting surface 34 by the photo-optic sensor switch 38. This "backs up" the gripper to receive and grip a stationary workpiece and then moves the gripper forwardly with the gripped workpiece.

With the preferred embodiment described above, the response of the gripper belt upon energization of the motor 26 by the photo-optic sensor assembly 38 and the motor control 54 is so fast that the gripper can engage and transport a moving workpiece with no appreciable loss in the velocity of the workpiece; i.e., the transfer of the moving workpiece from the guide ramp to the gripper belt proceeds smoothly. This feature is important where the workpiece must be transferred between two automated machines which are synchronized with each other. The motor control 54 can also include a time delay relay connected such that a predetermined time after the motor 26 is first energized its speed is either reduced or increased to match the speed and timing of the transported workpiece to the requirements of the next successive automated garment manufacturing device in the system.

Furthermore, although the gripper belt 28 described above is shown as traveling horizontally is should be apparent that it can also travel vertically or on an incline. These arrangements also introduce a time delay in the workpiece's horizontal travel, which may be advantageous in some applications.

The terms and expressions which have been employed here are used as terms of description and not of limitation, and there is no intention, in the use of such terms and expressions of excluding equivalents of the features shown and described, or portions thereof, it being recognized that various modifications are possible within the scope of the invention claimed.

What is claimed is:

1. A fabric workpiece transport mechanism comprising a pair of spaced apart wheels, a continuous drive belt of resilient material entrained about the wheels, switch actuated motor means for intermittently driving the wheels and the belt, at least one unitary gripper finger permanently attached to the belt for clasping the edge of a fabric workpiece against the belt, the gripper finger being bent inwardly toward the belt to deform the belt from its natural configuration, and sensor switch means for detecting the presence of a fabric workpiece edge between the gripper finger and the belt and for then energizing the motor means.

2. A workpiece transport mechanism as recited in claim 1, wherein the gripper, in the course of passing about the pulley wheels arcs away from the belt, whereby the edge of the fabric workpiece is free of the clasping action of the gripper finger.

3. A workpiece transport mechanism as recited in claim 1, further comprising a cam surface for flexing the gripper finger away from the belt, whereby the edge of the fabric workpiece is free of the clasping action of the gripper finger.

4. A workpiece transport mechanism as recited in claim 1, wherein the gripper finger includes a light reflecting surface which is covered by the fabric workpiece when the fabric workpiece is positioned between the gripper finger and the belt, a light source for directing light upon the reflecting surface, and wherein the sensor switch means include a photo-optic sensor switch for sensing the presence of the gripper finger at a particular location along its path of travel on the moving belt by detecting light reflected from the uncovered reflecting surface, the photo-optic sensor switch being electrically open when it detects the reflected light and electrically closed at all other times, the photo-optic sensor switch further being connected to operate the motor means, whereby when the fabric workpiece is positioned between the gripper finger and the belt, thereby covering the reflecting surface, the photo-optic sensor switch causes the motor to be energized and to drive the belt so as to carry along the gripped workpiece until the gripper finger is caused to arc away from the belt and release the workpiece and continues to drive the belt until the gripper is positioned to reflect light to the photo-optic sensor switch.

5. A workpiece transport mechanism as recited in claim 1, further comprising a horizontal support surface for receiving workpieces carried and released by the gripper finger and means for rotating the surface about a vertical axis.

6. A workpiece transport mechanism as recited in claim 1, further comprising a plurality of gripper fingers clamped to the belt at spaced apart locations.

7. A fabric workpiece transport mechanism as recited in claim 1 wherein the belt is a single piece and the unitary gripper finger is crimped onto the belt.

* * * * *